US010558135B1

(12) United States Patent
Kurita

(10) Patent No.: US 10,558,135 B1
(45) Date of Patent: Feb. 11, 2020

(54) IMAGE FORMING APPARATUS AND CARRYING CONTROL METHOD

(71) Applicant: TOSHIBA TEC KABUSHIKI KAISHA, Shinagawa-ku, Tokyo (JP)

(72) Inventor: Eizo Kurita, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/257,085

(22) Filed: Jan. 25, 2019

(51) Int. Cl.
*G03G 15/01* (2006.01)
*G03G 15/16* (2006.01)

(52) U.S. Cl.
CPC ..... *G03G 15/0131* (2013.01); *G03G 15/0184* (2013.01); *G03G 15/1615* (2013.01); *G03G 2215/00949* (2013.01); *G03G 2215/0158* (2013.01); *G03G 2215/0196* (2013.01)

(58) Field of Classification Search
CPC ... G03G 2215/0196; G03G 2215/0158; G03G 2215/00949; G03G 15/0184; G03G 15/1615; G03G 15/6558
See application file for complete search history.

(56) References Cited

U.S. PATENT DOCUMENTS 8,639,136 B2 1/2014 Tomura et al.
2008/0089702 A1* 4/2008 Takezawa ..... G03G 15/0194 399/32

* cited by examiner

*Primary Examiner* — Gregory H Curran
(74) *Attorney, Agent, or Firm* — Amin, Turocy & Watson, LLP

(57) ABSTRACT

According to one embodiment, an image forming apparatus of the embodiment includes a roller, a plurality of developing units, an image forming unit, a sensor, and a control unit. The rollers carry a sheet. The plurality of developing units include different types of developing materials. The image forming unit forms a plurality of images on a transfer belt by the developing materials of each of the plurality of developing units. The sensor reads the plurality of images formed on the transfer belt. The control unit controls the speed of the roller based on the positions of the plurality of images read by the sensor.

18 Claims, 8 Drawing Sheets

IMAGE FORMING APPARATUS AND CARRYING CONTROL METHOD

FIELD

Embodiments described herein relate generally to an image forming apparatus and a carrying control method.

BACKGROUND

In the related art, the speed of a motor used for carrying a sheet is set considering the dimensional tolerance of a component used for carrying the sheet. In addition, in the speed setting, an amount of deflection of the sheet should not be extremely large and should not be extremely small considering the length of the sheet. However, as the reduction of the size of the image forming apparatus progresses, a space for folding the sheet is reduced, and thus, a rotational speed of each roller should be more precisely set. Meanwhile, since a diameter of the roller is reduced, a variation in rotational speed due to a dimensional tolerance of the component significantly increases. As a result, the actual rotational speed of the roller is far from a set value of the motor speed related to ideal sheet carrying, and there is a resultant disadvantageous case where image defects occur.

DETAILED DESCRIPTION

An image forming apparatus of an embodiment includes a roller, a plurality of developing units, an image forming unit, a sensor, and a control unit. The rollers carry a sheet. The plurality of developing units include different types of developing materials. The image forming unit forms a plurality of images on a transfer belt by the developing materials of each of the plurality of developing units. The sensor reads the plurality of images formed on the transfer belt. The control unit controls the speed of the roller based on the positions of the plurality of images read by the sensor.

Hereinafter, the image forming apparatus and the carrying control method of the embodiment will be described with reference to the drawings.

First Embodiment

Figure 1:
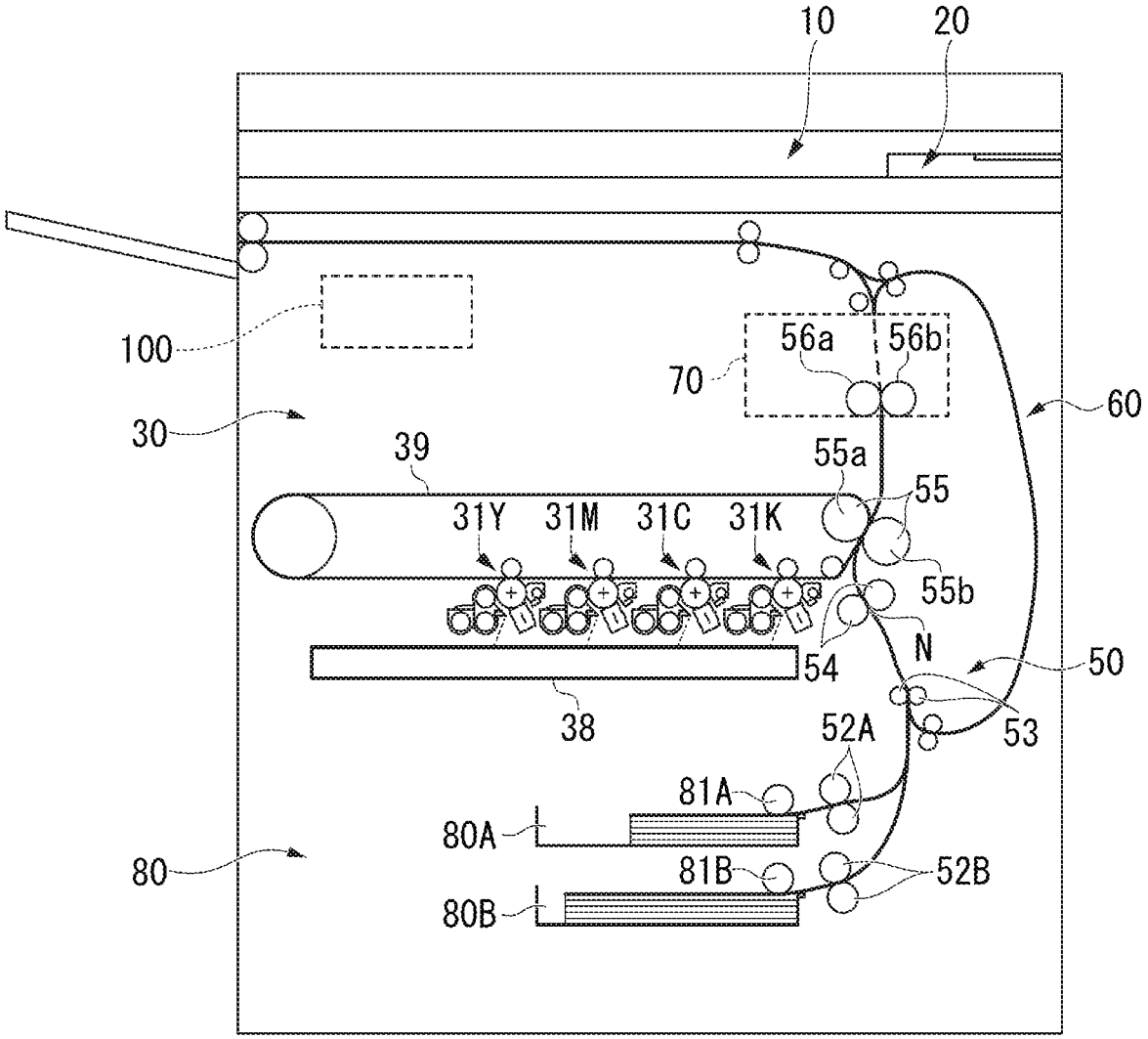
FIG. 1 is a view illustrating an overall configuration example of an image forming apparatus according to a first embodiment.

FIG. 1 is a view illustrating an overall configuration example of an image forming apparatus 1 according to a first embodiment.

The image forming apparatus 1 according to the first embodiment is a multifunction peripheral (MFP). The image forming apparatus 1 executes image forming. The image forming is processing of forming an image on a sheet. The sheet is, for example, a document, or a paper sheet on which characters or images are described. In addition, the sheet may be any object as long as the object can be read by the image forming apparatus 1. The image forming apparatus 1 reads the image that appears on the sheet, generates digital data, and generates an image file.

The image forming apparatus 1 includes an image reading unit 10, a control panel 20, a printer unit 30, a sheet storage unit 80, and a processor 100. In addition, the printer unit 30 of the image forming apparatus 1 may be a device that fixes a toner image or an ink jet type device. In the embodiment, a case where the printer unit 30 is a device that fixes the toner image will be described as an example.

The image reading unit 10 reads image information which is a reading target as light and dark of light. The image reading unit 10 records the read image information. The recorded image information may be transmitted to another information processing device via a network. The recorded image information may form the image on the sheet by the printer unit 30.

The control panel 20 includes a display unit and an operation unit. The display unit is a display device, such as a liquid crystal display and an organic electro luminescence (EL) display. The display unit displays various types of information related to the image forming apparatus 1. The operation unit includes a plurality of buttons and the like. The operation unit receives an operation of a user. For example, the operation unit receives an input of a print execution instruction from the user. The operation unit outputs a signal that corresponds to the operation performed by the user to the control unit of the image forming apparatus 1. In addition, the display unit and the operation unit may be configured as an integrated touch panel.

The printer unit 30 executes the image forming. The printer unit 30 forms the image on the sheet based on the image information generated by the image reading unit 10 or the image information received via a communication path. In addition, in the embodiment, the printer unit 30 uses a non-decolorizable recording agent toner (hereinafter, referred to as "normal toner"). The normal toner is, for example, a toner of yellow (Y), magenta (M), cyan (C), black (K) or the like.

The sheet storage unit 80 includes a plurality of cassettes. For example, the sheet storage unit 80 includes a first cassette 80A and a second cassette 80B. The first cassette 80A and the second cassette 80B accommodate sheets of different sizes or different types therein.

The first cassette 80A and the second cassette 80B respectively include pickup rollers 81A and 81B. The pickup roller 81A and the pickup roller 81B take out the sheets one by one from the first cassette 80A and the second cassette 80B, respectively. The pickup roller 81A and the pickup roller 81B feed the sheets taken out from the first cassette 80A and the second cassette 80B to a carrying path 50. In the following description, the part closer to the pickup roller 81A and the pickup roller 81B is defined as the upstream side in the carrying path 50, and the part closer to a discharge tray is defined as the downstream side in the carrying path 50.

The carrying path 50 carries the sheet in the printer unit 30 and the sheet storage unit 80. The carrying path 50 includes a paper feed roller 52A, a paper feed roller 52B, a carrying roller 53, and a resistance roller 54.

The paper feed roller 52A and the paper feed roller 52B carry the sheet fed by the pickup roller 81A and the pickup roller 81B to the resistance roller 54. The resistance roller 54 carries the sheet to a transfer unit 55 side in accordance with the timing at which the transfer unit 55 of the printer unit 30 transfers the toner image onto the surface of the sheet. The resistance roller 54 aligns a leading end of the sheet sent by the carrying roller 53 at a nip N, and then carries the sheet to the transfer unit 55 side. The resistance roller 54 is disposed further upstream of the carrying path 50 than a secondary transfer roller 55*b*.

The transfer unit 55 includes a secondary transfer opposing roller 55*a* and the secondary transfer roller 55*b*. The secondary transfer opposing roller 55*a* transfers the toner image on an intermediate transfer belt 39 to the sheet. The secondary transfer roller 55*b* is disposed at a position opposing the secondary transfer opposing roller 55*a* nipping the intermediate transfer belt 39 therebetween. The secondary transfer roller 55*b* nips the sheet between the secondary transfer roller 55*b* itself and the secondary transfer opposing roller 55*a*, and carries the sheet to which the image was transferred to the carrying path 50.

The processor 100 controls each functional unit of the image forming apparatus 1. A specific description of the processor 100 will be described later.

Next, a detailed configuration of the printer unit 30 will be described. The printer unit 30 includes a developing unit 31, an exposure unit 38, the intermediate transfer belt 39, the transfer unit 55, a reversing unit 60, and a fixing unit 70. In the embodiment, the developing unit 31 includes a predetermined number of toners. Hereinafter, the developing unit that corresponds to a toner of yellow (Y) is described as a developing unit 31Y, and the developing unit that corresponds to a toner of magenta (M) is described as a developing unit 31M. In addition, the developing unit that corresponds to a toner of cyan (C) is described as a developing unit 31C, and the developing unit that corresponds to a toner of black (K) is described as a developing unit 31K.

Each developing unit 31 (31Y, 31M, 31C, and 31K) supplies a developer that exists in a developer storage unit to a photoconductive drum. The developer storage unit is a container that stores the developer therein. The developer is a mixture of a carrier containing magnetic fine particles, and each of the toners. When the developer is agitated, the toner is frictionally charged. According to this, the toner adheres to a surface of the carrier by an electrostatic force. In the developer storage unit, a first mixer, a second mixer, a developing roller, and a temperature and humidity sensor are disposed. The first mixer and the second mixer agitate the developer. The first mixer and the second mixer carry the developer. The second mixer is disposed below the developing roller. The second mixer supplies the developer stored in the developer storage unit to the surface of the developing roller. The temperature and humidity sensor measures the temperature and humidity on the inside of the developer storage unit as a state of the printer unit 30.

The developing roller rotates counterclockwise by the driving of the developing motor. The developing roller is configured with a magnetic material (magnet) in which a negative electrode and a positive electrode are arranged alternately along a circumferential shape. The developer supplied by the second mixer spikes up on the surface of the developing roller in a brush shape in accordance with a magnetic field distribution of the developing roller. As the developing roller rotates, the developer that spiked up comes into contact with the surface of the photoconductive drum in a sweeping manner. In addition, the magnetic field distribution of the developing roller can be switched. The developing unit 31 performs the spiking and cutting of the developer by switching the magnetic field distribution of the developing roller. The developing roller is connected to a voltage application circuit. The voltage application circuit applies a voltage as a developing bias to the developing roller under the control of the processor 100. The voltage applied to the developing roller is, for example, a DC voltage of negative polarity.

The photoconductive drum has a photoconductive layer on the surface. The photoconductive drum rotates clockwise by the driving of the developing motor. The developing unit 31, a charging unit, a discharging unit, a cleaning unit, and a transfer roller are disposed around the photoconductive drum.

The charging unit uniformly charges the surface (photoconductive layer) of the photoconductive drum. For example, the charging unit negatively charges the surface (photoconductive layer) of the photoconductive drum. According to this, the toner image is formed on the surface (photoconductive layer) of the photoconductive drum in accordance with an electrostatic latent image.

For example, the developing unit 31Y develops the electrostatic latent image on the surface (photoconductive layer) of the photoconductive drum with the toner of yellow (Y). In addition, the developing unit 31M develops the electrostatic latent image on the surface (photoconductive layer) of the photoconductive drum with the toner of magenta (M). Further, the developing unit 31C develops the electrostatic latent image on the surface (photoconductive layer) of the photoconductive drum with the toner of cyan (C). In addition, the developing unit 31K develops the electrostatic latent image on the surface (photoconductive layer) of the photoconductive drum with the toner of black (K).

The cleaning unit removes an untransferred toner or the like by scraping off or the like the untransferred toner on the surface of the photoconductive drum. After the toner image is transferred from the photoconductive drum onto the intermediate transfer belt 39, the cleaning unit removes the toner on the surface of the photoconductive drum. The toner removed by the cleaning unit is collected in a waste toner tank and discarded.

The discharging unit opposes the photoconductive drum passed through the cleaning unit. The discharging unit irradiates the surface of the photoconductive drum with light. According to this, the uneven charges on the photoconductive layer are made uniform. In other words, the photoconductive layer is discharged.

The transfer roller opposes the photoconductive drum nipping the intermediate transfer belt 39 therebetween. The transfer roller abuts against the surface of the photoconductive drum nipping the intermediate transfer belt 39 therebetween. The transfer roller transfers (primarily transfers) the toner image on the surface of the photoconductive drum onto the intermediate transfer belt 39.

The exposure unit 38 is provided at a position opposing the photoconductive drum of each of the developing units 31Y, 31M, 31C, and 31K. The exposure unit 38 irradiates the surface (photoconductive layer) of the photoconductive drum of each of the developing units 31Y, 31M, 31C, and 31K with laser light. The exposure unit 38 is controlled to emit light based on the image information under the control of the processor 100. The exposure unit 38 emits the laser light based on the image information. According to this, the negative charges on the surface (photoconductive layer) of the photoconductive drum of each of the developing units 31Y, 31M, 31C, and 31K disappear. As a result, a static electricity pattern is formed on the surface (photoconductive layer) of the photoconductive drum at the position irradiated with the laser light. In other words, an electrostatic latent image is formed on the surface (photoconductive layer) of the photoconductive drum by irradiation of the laser light by the exposure unit 38. In addition, the exposure unit 38 may use light emitting diode (LED) light instead of the laser light.

The reversing unit 60 reverses the sheet discharged from the fixing unit 70 by switchback. The reversing unit 60 carries the reversed sheet to the front of the resistance roller 54 again. The reversing unit 60 reverses the sheet in order to form the toner image on a back surface of the sheet to which the fixing is performed.

The fixing unit 70 applies heat and pressure to the sheet. The fixing unit 70 fixes the toner image transferred to the sheet by the heat and the pressure. The fixing unit 70 includes fixing rollers 56*a* and 56*b*. The fixing roller 56*a* is disposed at a position opposing the fixing roller 56*b*. The fixing roller 56*a* nips the sheet between the fixing roller 56*a* and the fixing roller 56*b*, and carries the sheet to which the image was fixed to the carrying path 50. The fixing roller 56*b* includes a heating unit therein, and fixes the toner image transferred onto the sheet. In addition, when the fixing rollers 56*a* and 56*b* are not particularly distinguished, the fixing rollers 56*a* and 56*b* will be described as fixing roller 56. The fixing roller 56 is disposed further downstream of the carrying path 50 than the secondary transfer roller 55*b*.

In the printer unit 30, an alignment sensor (not illustrated) is installed inside a pre-secondary transfer guide (not illustrated) below the intermediate transfer belt 39. The alignment sensor reads a plurality of toner images formed on the intermediate transfer belt 39. For example, the alignment sensor acquires information on color and positional relationship of the plurality of toner images.

Figure 2:
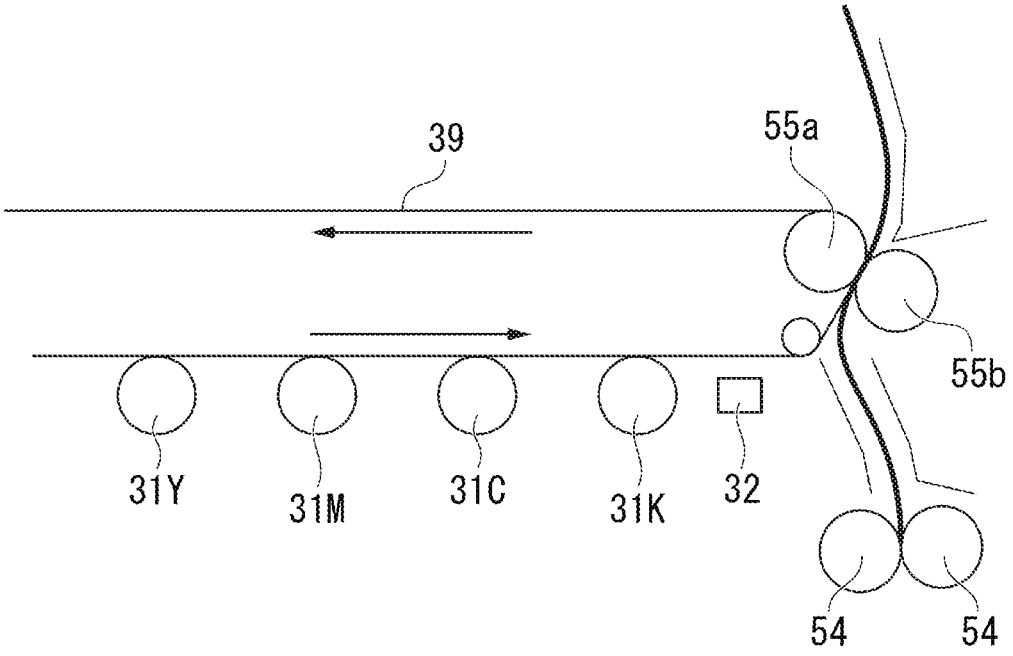
FIG. 2 is a schematic view illustrating a configuration from a resistance roller to a transfer unit.

FIG. 2 is a schematic view illustrating a configuration from the resistance roller 54 to the transfer unit 55. In FIG. 2, the arrow indicates a rotational direction of the intermediate transfer belt 39. In addition, in the plurality of developing units 31Y, 31M, 31C, and 31K, the part closer to the developing unit 31Y is defined as the upstream side in the developing unit 31, and the part closer to the developing unit 31K is defined as the downstream side in the developing unit. The alignment sensor 32 is provided on the downstream side in the developing unit.

Further, the rotational speed of the secondary transfer opposing roller 55*a* is preset. The rotational speed of the resistance roller 54 is set to a speed higher than the rotational speed of the secondary transfer opposing roller 55*a* such that the sheet has a certain deflection. However, when the rotational speed of the resistance roller 54 becomes lower than the rotational speed of the secondary transfer opposing roller 55*a* due to the carrying of the sheet, a brake is applied to the carrying of the sheet.

In this case, since the brake is also applied to the secondary transfer opposing roller 55*a*, the brake is applied to the intermediate transfer belt 39. As a result, the forming positions of the toner images by each of the developing units 31 are shifted. In the embodiment, the plurality of images formed on the intermediate transfer belt 39 are read by the alignment sensor 32 by the developing material held by each of the two types of developing units 31 between the sheets which are being carried. In addition, the image forming apparatus 1 controls the rotational speed of the resistance roller 54 based on the positions of the plurality of images.

Figure 3:
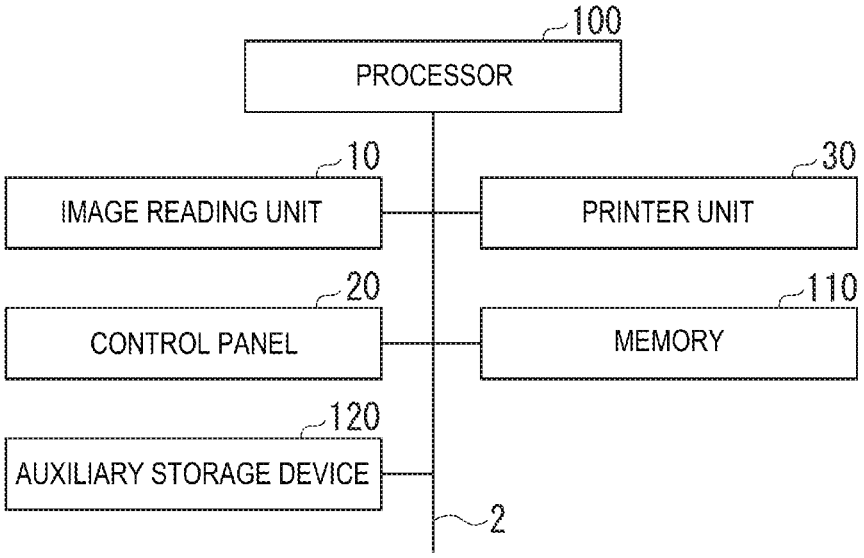
FIG. 3 is a block diagram illustrating a hardware configuration.

FIG. 3 is a block diagram illustrating a hardware configuration of the image forming apparatus 1.

Since the image reading unit 10, the control panel 20, and the printer unit 30 illustrated in FIG. 3 are the same as those described above, the description thereof will be omitted. Hereinafter, the processor 100, a memory 110, and an auxiliary storage device 120 will be described. In addition, each of the functional units is connected so as to be capable of performing data communication via a system bus 2.

The processor 100 is, for example, a processor, such as a central processing unit (CPU). The processor 100 expands a program stored in a read only memory (ROM) in the memory 110 and executes various types of processing by executing the expanded program.

The memory 110 is, for example, a random access memory (RAM). The memory 110 temporarily stores data used by each of the functional units of the image forming apparatus 1. In addition, the memory 110 may store digital data generated by the image reading unit 10. The memory 110 may temporarily store jobs and job logs.

The auxiliary storage device 120 is, for example, a hard disk or a solid state drive (SSD) and stores various types of data. The various types of data are, for example, digital data, jobs, and job logs.

Figure 4:
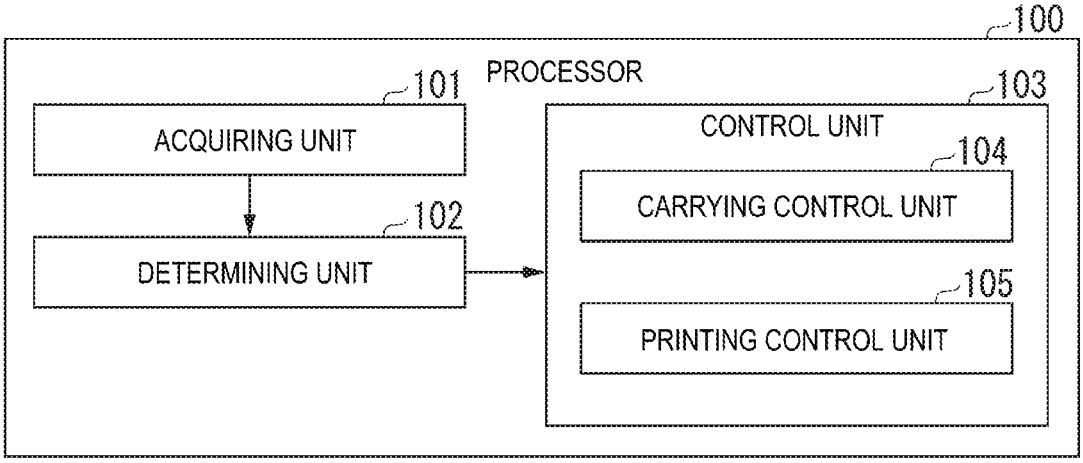
FIG. 4 is a schematic block diagram illustrating a functional configuration of a processor according to the first embodiment.

FIG. 4 is a schematic block diagram illustrating a functional configuration of the processor 100 according to the first embodiment. The processor 100 includes an acquiring unit 101, a determining unit 102, and a control unit 103 by executing the program.

The acquiring unit 101 acquires information on color and positional relationship of the plurality of toner images obtained by the alignment sensor 32.

The determining unit 102 calculates the amount of a positional shift based on the information on the positional relationship of the plurality of toner images acquired by the acquiring unit 101 and determines whether or not the shift amount is equal to or greater than the threshold value.

The control unit 103 includes a carrying control unit 104 and a printing control unit 105.

The carrying control unit 104 controls the carrying of sheets by controlling various rollers. Specifically, the carrying control unit 104 controls the rotational speed of the resistance roller 54 when the determining unit 102 determines that the shift amount is equal to or greater than the threshold value. For example, the carrying control unit 104 increases the rotational speed of the resistance roller 54 by a predetermined amount (for example, 0.1%). Meanwhile, when the determining unit 102 determines that the shift amount is less than the threshold value, the carrying control unit 104 maintains the rotational speed of the resistance roller 54 while maintaining the current state.

The printing control unit 105 controls the two types of developing units 31 at a first timing to form the plurality of toner images on the intermediate transfer belt 39. The two types of developing units 31 may be any combination as long as the developing units 31 are two types of developing units 31 among the developing units 31Y, 31M, 31C, and 31K. In the following description, an example in which the two types of developing units 31 are two combinations of the developing unit 31Y and the developing unit 31K will be described. Further, the toner image formed by the developing unit 31Y is described as a first toner image, and the toner image formed by the developing unit 31K is described as a second toner image.

Further, the first timing may be any timing as long as the toner image is not transferred onto the sheet. For example, the first timing may be a timing between the sheets during the carrying of the sheet, or may be a timing when the carrying of the sheet is completed.

Figure 5:
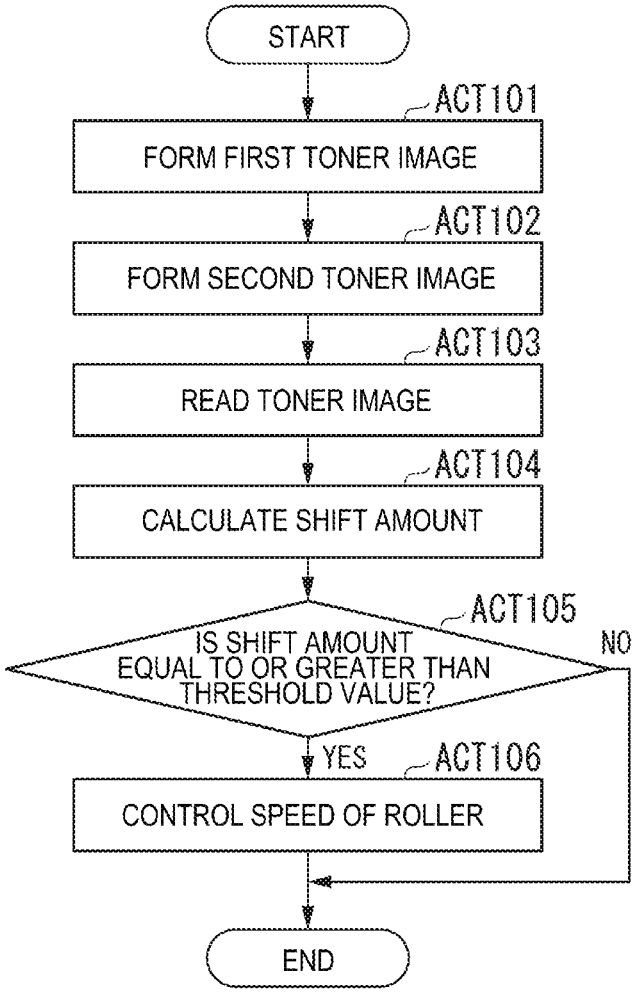
FIG. 5 is a flowchart illustrating a flow of processing.

FIG. 5 is a flowchart illustrating a flow of processing of the image forming apparatus 1 according to the first embodiment. The processing of FIG. 5 is executed, for example, as the first timing in a period between the sheets during the carrying of the sheet.

The printing control unit 105 forms the first toner image on the intermediate transfer belt 39 by using the developing material of the developing unit 31Y. The developing unit 31Y forms the first toner image on the intermediate transfer belt 39 by using the developing material (ACT 101). In addition, the printing control unit 105 forms the second toner image on the intermediate transfer belt 39 by using the developing material of the developing unit 31K. The developing unit 31K forms the second toner image on the intermediate transfer belt 39 by using the developing material (ACT 102).

The alignment sensor 32 reads information on color and positional relationship of the first toner image and the second toner image formed on the intermediate transfer belt 39 (ACT 103). The alignment sensor 32 outputs information on color and positional relationship of the read first toner image and second toner image to the processor 100.

The acquiring unit 101 acquires information on color and positional relationship of the first toner image and the second toner image output from the alignment sensor 32. The determining unit 102 calculates the shift amount based on the positional information of the first toner image and the second toner image acquired by the acquisition unit 101 (ACT 104). Specifically, the determining unit 102 calculates the shift amount between the position of the first toner image and the position of the second toner image. The determining unit 102 determines whether or not the calculated shift amount is equal to or greater than the threshold value (ACT 105).

When the calculated shift amount is less than the threshold value (ACT 105: NO), the carrying control unit 104 does not control the speed of the roller. In other words, the carrying control unit 104 maintains the speed of the resistance roller 54 while maintaining the current state.

Meanwhile, when the calculated shift amount is equal to or greater than the threshold value (ACT 105: YES), the carrying control unit 104 controls the rotational speed of the roller (ACT 106). Specifically, the carrying control unit 104 increases the rotational speed of the resistance roller 54 by a predetermined amount (for example, 0.10).

Figure 6:
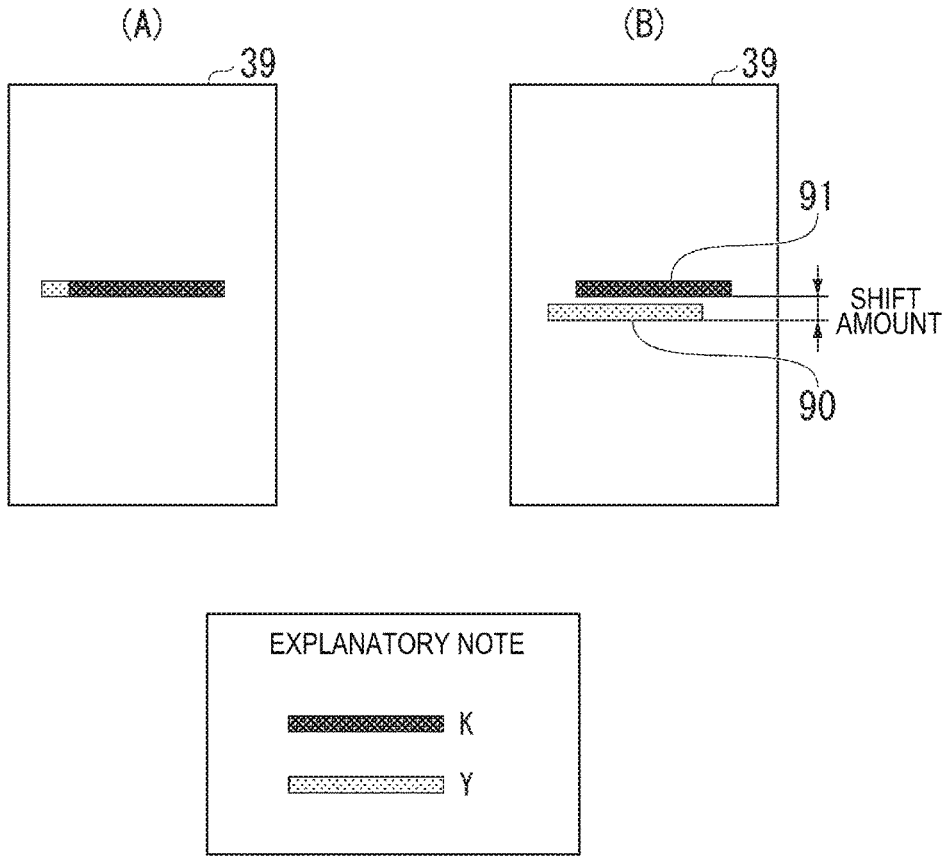
FIG. 6 is a view illustrating an example of a plurality of toner images formed on an intermediate transfer belt.

FIG. 6 is a view illustrating an example of the plurality of toner images formed on the intermediate transfer belt 39. FIG. 6A is a view illustrating an example in which the positions of the plurality of toner images are not shifted, and FIG. 6B is a view illustrating an example in which the positions of the plurality of toner images are shifted. As illustrated in FIG. 6B, the determining unit 102 performs the determination based on the shift amount between the position of a first toner image 90 and the position of a second toner image 91.

According to the image forming apparatus 1 configured as described above, occurrence of image defects can be prevented. Specifically, the image forming apparatus 1 forms the toner image on the intermediate transfer belt 39 by each of the plurality of developing units between the sheets during the carrying of the sheet. The alignment sensor 32 reads information on the positional relationship of the position of the first toner image and the position of the second toner image which are formed on the intermediate transfer belt 39.

In addition, the image forming apparatus 1 controls the rotational speed of the resistance roller 54 when the shift amount between the position of the first toner image and the position of the second toner image is equal to or greater than the threshold value. For example, the image forming apparatus 1 increases the rotational speed of the resistance roller 54 to be higher than the current speed. Accordingly, it is possible to correct the shift caused by influences of a speed change due to component tolerance, a speed change due to environment, and the like. Therefore, occurrence of image defects can be prevented. In addition, the speed change due to the environment is a change in speed caused by repeated expansion or contraction of the roller due to the temperature or lamp heat.

Hereinafter, a modification example of the image forming apparatus 1 according to the first embodiment will be described.

The image forming apparatus 1 may be configured to repeat the processing of ACT 101 to ACT 106 until the shift amount becomes less than the threshold value. In this case, the carrying control unit 104 increases the speed of the resistance roller 54 by a predetermined amount (for example, 0.1%) every time processing of ACT 106 is performed.

In the embodiment, a configuration in which the shift amount is adjusted by changing the speed relationship between the resistance roller 54 and the secondary transfer roller 55*b* has been described. The image forming apparatus 1 may be configured to adjust the shift amount by changing the speed relationship between the secondary transfer roller 55*b* and the fixing roller 56. Regarding the configuration in such a case, FIG. 7 will such be described.

Figure 7:
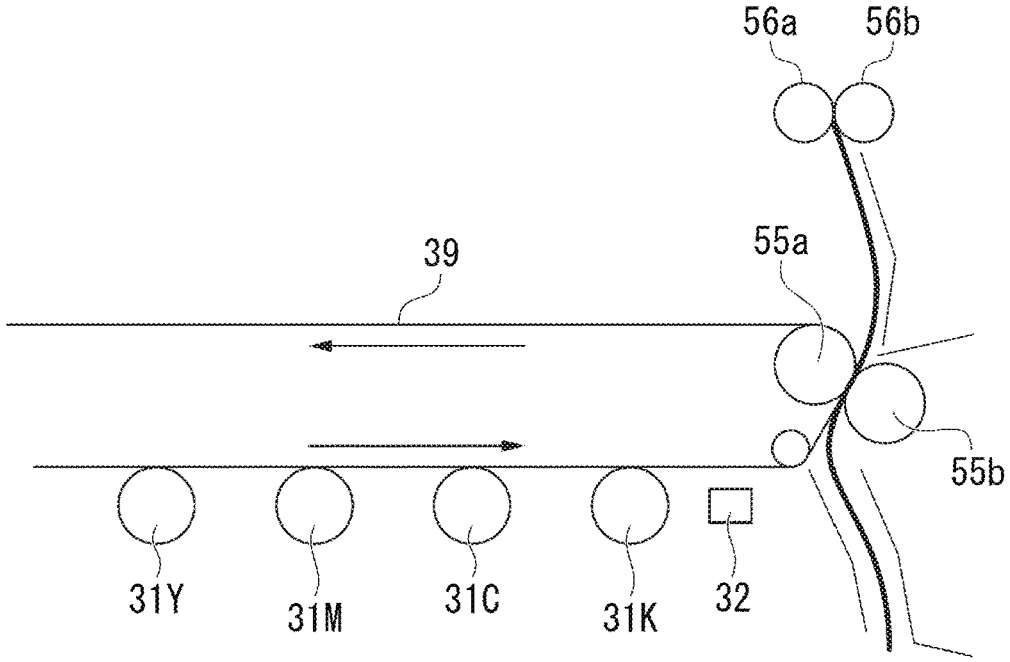
FIG. 7 is a schematic view illustrating a configuration from a secondary transfer roller to a fixing roller.

FIG. 7 is a schematic view illustrating the configuration from the secondary transfer roller 55*b* to the fixing roller 56. In FIG. 7, the arrow indicates the rotational direction of the intermediate transfer belt 39.

The rotational speed of the fixing roller 56 is set to be lower than the rotational speed of the secondary transfer opposing roller 55*a*. Therefore, the sheet has a certain deflection between the secondary transfer opposing roller 55*a* and the fixing roller 56. However, when the rotational speed of the fixing roller 56 is increased, the rotational speed of the fixing roller 56 becomes higher than the rotational speed of the secondary transfer opposing roller 55*a* at a certain point. In this case, the sheet is pulled by the fixing roller 56. At this time, the sheet is also pulled against the secondary transfer opposing roller 55*a*, and the intermediate transfer belt 39 is pulled. As a result, the forming positions of the toner images by each of the developing units 31 are shifted. In this case, the image forming apparatus 1 controls the rotational speed of the fixing roller 56 based on the positions of the plurality of images.

Specifically, after executing the processing of ACT 101 to ACT 105, the image forming apparatus 1 makes the rotational speed of the fixing roller 56 low by a predetermined amount when the shift amount is equal to or greater than the threshold value. In addition, when the shift amount is less than the threshold value, the carrying control unit 104 does not control the speed of the roller. In other words, the carrying control unit 104 maintains the speed of the fixing roller 56 while maintaining the current state.

Second Embodiment

In a second embodiment, the image forming apparatus 1 controls the rotational speed of the resistance roller 54 and the fixing roller 56. Hereinafter, differences between the image forming apparatus 1 according to the second embodiment and that of the first embodiment will be described.

Figure 8:
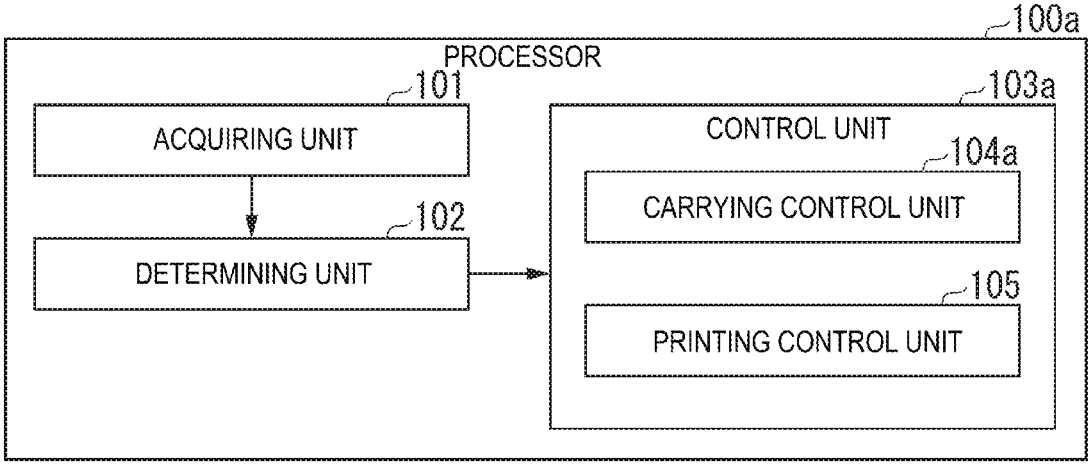
FIG. 8 is a schematic block diagram illustrating a functional configuration of a processor according to a second embodiment.

FIG. 8 is a schematic block diagram illustrating a functional configuration of a processor 100*a* according to the second embodiment. The processor 100*a* includes the acquiring unit 101, the determining unit 102, and a control unit 103*a* by executing the program. The control unit 103*a* includes a carrying control unit 104*a* and the printing control unit 105.

The carrying control unit 104*a* controls the carrying of sheets by controlling various rollers. Specifically, the carrying control unit 104*a* controls the rotational speed of a first roller when the determining unit 102 determines that the shift amount is equal to or greater than the threshold value. The first roller is, for example, a resistance roller 54. The carrying control unit 104*a* increases the rotational speed of the resistance roller 54 by a predetermined amount (for example, 0.10). Meanwhile, when the determining unit 102 determines that the shift amount is less than the threshold value, the carrying control unit 104*a* maintains the rotational speed of the resistance roller 54 while maintaining the current state.

In addition, the carrying control unit 104*a* controls the rotational speed of a second roller when the determining unit 102 determines that the shift amount is equal to or greater than the threshold value after the speed control of the first roller is performed. The second roller is, for example, the fixing roller 56. The carrying control unit 104*a* reduces the rotational speed of the fixing roller 56 by a predetermined amount (for example, 0.1%). Meanwhile, when the determining unit 102 determines that the shift amount is less than the threshold value, the carrying control unit 104*a* maintains the rotational speed of the fixing roller 56 while maintaining the current state.

Figure 9:
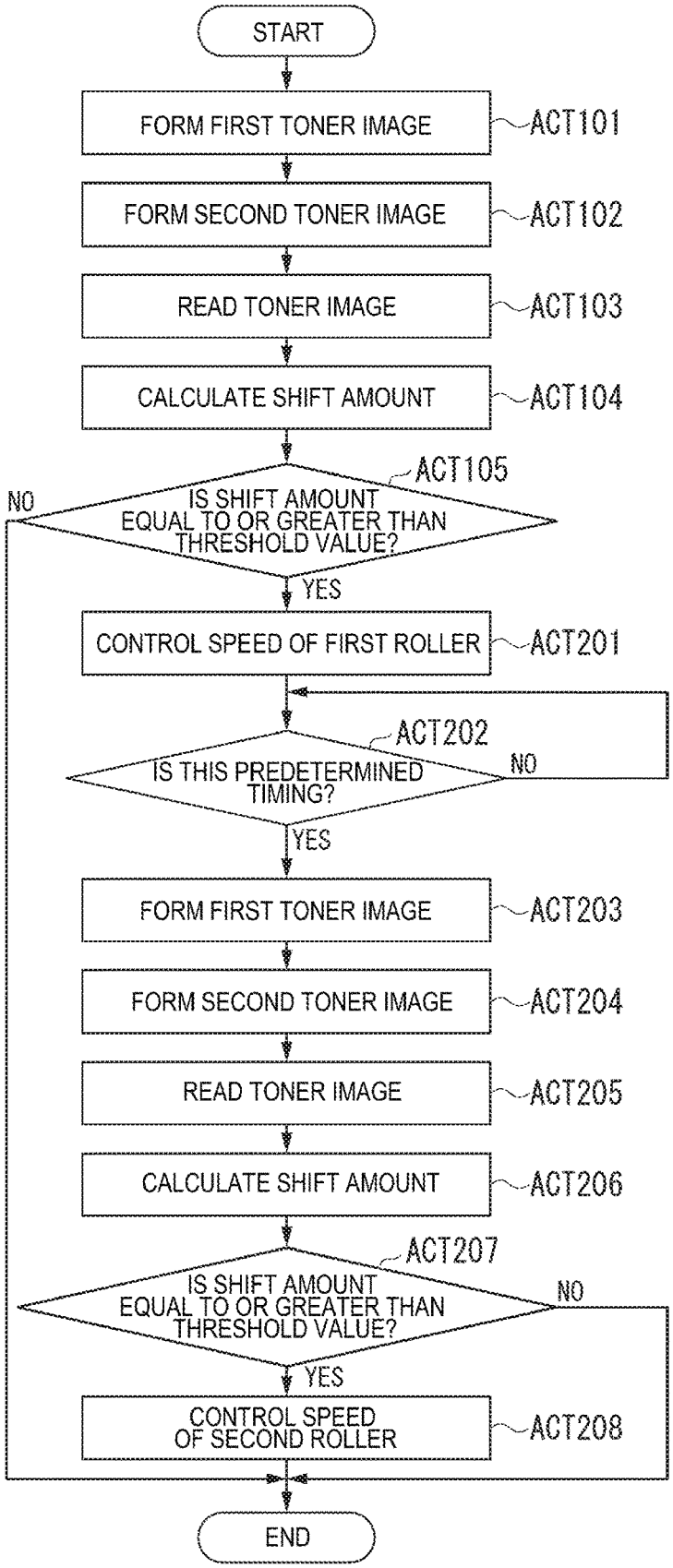
FIG. 9 is a flowchart illustrating a flow of processing of an image forming apparatus according to the second embodiment.

FIG. 9 is a flowchart illustrating a flow of processing of the image forming apparatus 1 according to the second embodiment. The processing of FIG. 9 is executed, for example, as the first timing in a period between the sheets during the carrying of the sheet. In FIG. 9, the same reference numerals will be given to the same processing as those in FIG. 6, and the description thereof will be omitted.

In the processing of ACT 105, when the shift amount is equal to or greater than the threshold value (ACT 105: YES), the carrying control unit 104*a* controls the rotational speed of the first roller (ACT 201). Specifically, the carrying control unit 104*a* increases the rotational speed of the resistance roller 54 by a predetermined amount (for example, 0.1%).

After this, the determining unit 102 determines whether or not the predetermined timing has come (ACT 202). The predetermined timing is, for example, a period between the sheets during the carrying of the sheet. When the predetermined timing has not come (ACT 202: NO), the image forming apparatus 1 waits until reaching a predetermined timing.

When the predetermined timing has come (ACT 202: YES), the printing control unit 105 forms the first toner image on the intermediate transfer belt 39 by using the developing material of the developing unit 31Y. The developing unit 31Y forms the first toner image on the intermediate transfer belt 39 by using the developing material (ACT 203).

In addition, the printing control unit 105 forms the second toner image on the intermediate transfer belt 39 by using the developing material of the developing unit 31K. The developing unit 31K forms the second toner image on the intermediate transfer belt 39 using the developing material (ACT 204).

The alignment sensor 32 reads information on color and positional relationship of the first toner image and the second toner image formed on the intermediate transfer belt 39 (ACT 205). The alignment sensor 32 outputs information on color and positional relationship of the read first toner image and second toner image to the processor 100*a*.

The acquiring unit 101 acquires information on color and positional relationship of the first toner image and the second toner image output from the alignment sensor 32. The determining unit 102 calculates the shift amount based on the positional information of the first toner image and the second toner image acquired by the acquisition unit 101 (ACT 206). Specifically, the determining unit 102 calculates the shift amount between the position of the first toner image and the position of the second toner image. The determining unit 102 determines whether or not the calculated shift amount is equal to or greater than the threshold value (ACT 207).

When the calculated shift amount is less than the threshold value (ACT 207: NO), the carrying control unit 104*a* does not control the speed of the roller. For example, the carrying control unit 104*a* maintains the speed of the resistance roller 54 and the fixing roller 56 while maintaining the current state.

Meanwhile, when the calculated shift amount is equal to or greater than the threshold value (ACT 207: YES), the carrying control unit 104*a* controls the rotational speed of the second roller (ACT 208). Specifically, the carrying control unit 104*a* reduces the rotational speed of the fixing roller 56 by a predetermined amount (for example, 0.1%).

The image forming apparatus 1 according to the second embodiment configured as described above can obtain the same effects as those of the first embodiment.

In addition, the image forming apparatus 1 controls the rotational speed of the resistance roller 54 and the fixing roller 56 when the shift amount between the position of the first toner image and the position of the second toner image is equal to or greater than the threshold value. Accordingly, when the shift is not improved in the speed control of the resistance roller 54, it is possible to improve the shift by controlling the speed of other rollers. Therefore, the image forming apparatus 1 can correct the shift with a plurality of patterns. Therefore, occurrence of image defects can be prevented.

Hereinafter, a modification example of the image forming apparatus 1 according to the second embodiment will be described.

The first roller may be the fixing roller 56 and the second roller may be the resistance roller 54. In this case, the image forming apparatus 1 controls the rotational speed of the fixing roller 56 in the processing of ACT 201. In addition, the image forming apparatus 1 controls the rotational speed of the resistance roller 54 in the processing of ACT 208.

Third Embodiment

In a third embodiment, the image forming apparatus 1 determines the cause of the shift based on the shift amount obtained when the paper sheet is passing and the shift amount obtained when the paper sheet is not passing, and performs correction. Hereinafter, differences between the image forming apparatus 1 according to the third embodiment and that of the first embodiment will be described.

Figure 10:
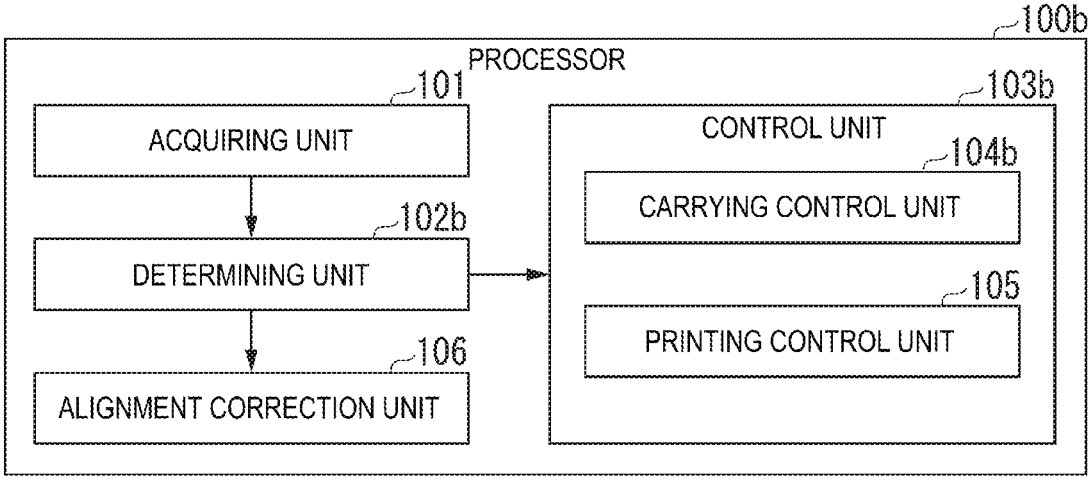
FIG. 10 is a schematic block diagram illustrating a functional configuration of a processor according to a third embodiment.

FIG. 10 is a schematic block diagram illustrating a functional configuration of a processor 100*b* according to the third embodiment. By executing a program, the processor 100*b* includes the acquiring unit 101, a determining unit 102*b*, a control unit 103*b*, and an alignment correction unit 106. The control unit 103*b* includes a carrying control unit 104*b* and the printing control unit 105.

The determining unit 102*b* calculates the amount of a positional shift based on the information on the positional relationship of the plurality of toner images acquired by the acquiring unit 101 and determines whether or not the shift amount is equal to or greater than the threshold value. The determining unit 102*b* determines the cause of the shift based on the shift amount obtained when the paper sheet is passing and the shift amount obtained when the paper sheet is not passing, and performs correction. The cause of the shift is the cause of the shift amount being equal to or greater than the threshold value in the plurality of toner images. A case where the paper sheet is not passing is a case where no sheet is fed onto the carrying path 50, for example, after the image forming is completed or before the image forming is executed.

The carrying control unit 104*b* controls the carrying of sheets by controlling various rollers. Specifically, the carrying control unit 104*b* controls the rotational speed of the resistance roller 54 or the fixing roller 56 when the determining unit 102*b* determines that the shift amount is equal to or greater than the threshold value. When the determining unit 102*b* determines that the shift amount is less than the threshold value, the carrying control unit 104*b* maintains the rotational speed of the resistance roller 54 and the fixing roller 56 while maintaining the current state.

The alignment correction unit 106 performs alignment correction of an optical system in the exposure unit 38. Since the alignment correction method is the same as the existing method, the description thereof will be omitted.

Figure 11:
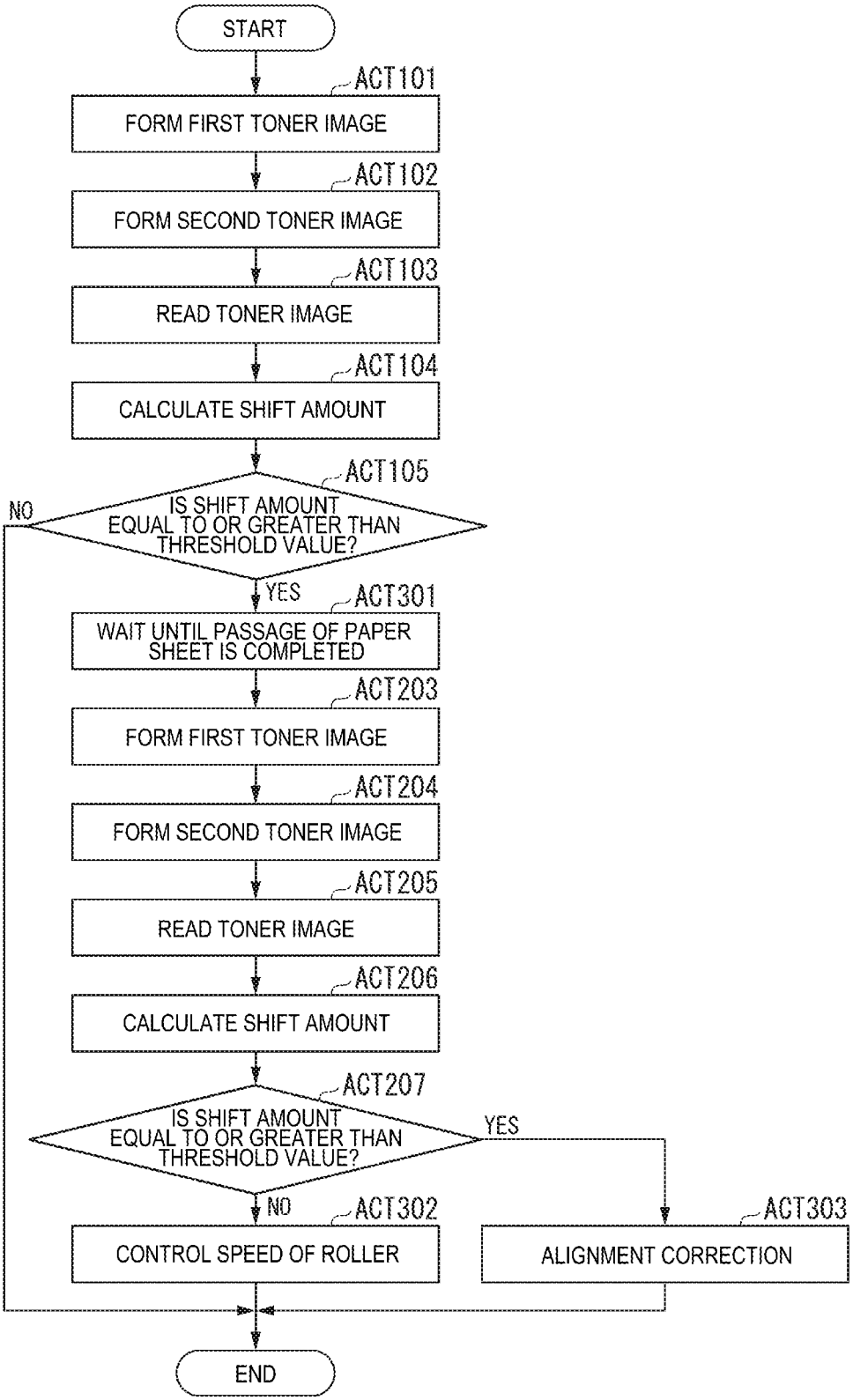
FIG. 11 is a flowchart illustrating a flow of processing of an image forming apparatus according to the third embodiment.

FIG. 11 is a flowchart illustrating a flow of processing of the image forming apparatus 1 according to the third embodiment. The processing of FIG. 11 is executed, for example, as the first timing in a period between the sheets during the carrying of the sheet. In FIG. 11, the same reference numerals will be given to the same processing as those in FIG. 9, and the description thereof will be omitted.

In the processing of ACT 105, when the shift amount is equal to or greater than the threshold value (ACT 105: YES), the image forming apparatus 1 waits until the passage of the paper sheet is completed (ACT 301). When the passage of the paper sheet is completed, the image forming apparatus 1 executes the processing of ACT 203 to ACT 207.

In the processing of ACT 207, when the calculated shift amount is less than the threshold value (ACT 207: NO), the determining unit 102*b* determines that the cause of the shift is the roller speed. There is a case where the relationship between the rotational speed of the secondary transfer opposing roller 55*a* and the rotational speed of the resistance roller 54 or the fixing roller 56 is not appropriate in a state where the paper sheet is passing. In such a case, a pulling force or a braking force is generated in the intermediate transfer belt 39. Therefore, when the shift amount is equal to or greater than the threshold value in determination made between the sheets, there is a possibility of a positional shift due to the influence of the roller.

Meanwhile, the relationship between the rotational speed of the secondary transfer opposing roller 55*a* and the rotational speed of the resistance roller 54 or the fixing roller 56 does not have influence in a state where the paper sheet is not passing. In other words, a pulling force or a braking force is not generated in the intermediate transfer belt 39. Therefore, when the shift amount is equal to or greater than the threshold value in determination made in a state where the paper sheet is not passing, there is a possibility of a positional shift due to the influence of other than the roller. The influence other than the roller is the influence of the optical system in the developing unit 31, for example.

Therefore, when the shift amount is equal to or greater than the threshold value in the processing of ACT 105 and the shift amount is less than the threshold value in the processing of ACT 207, there is a high possibility that the cause of the shift is the roller speed. Here, the determining unit 102*b* determines that the cause of the shift is the roller speed.

In addition, when the shift amount is equal to or greater than the threshold value in the processing of ACT 105 and ACT 207, there is a high possibility that the cause of the shift is the optical system in the developing unit 31. Here, the determining unit 102*b* determines that the cause of the shift is the optical system in the developing unit 31.

After this, the carrying control unit 104*b* controls the roller speed (ACT 302). Specifically, the carrying control unit 104*b* increases the rotational speed of the resistance roller 54 by a predetermined amount (for example, 0.1%). In addition, the carrying control unit 104*b* may reduce the rotational speed of the fixing roller 56 by a predetermined amount (for example, 0.1%).

Meanwhile, when the calculated shift amount is equal to or greater than the threshold value (ACT 207: YES), the determining unit 102*b* determines that the cause of the shift is the optical system. In this case, the alignment correction unit 106 performs alignment correction by correcting the optical system in the developing unit (ACT 303).

The image forming apparatus 1 according to the third embodiment configured as described above determines the cause of the shift and performs necessary correction. Accordingly, the shift can be improved. Therefore, the image forming apparatus 1 can control occurrence of image defects.

Modification examples common to the first to third embodiments will be described.

In the fixing unit 70 of each of the above-described embodiments, a method of fixing the toner image onto the paper sheet by heating through a film-like member may be applied.

A part of functions of the image forming apparatus 1 in the above-described embodiments may be realized by a computer. In this case, a program for realizing the function is recorded in a computer-readable recording medium. In addition, the function may be realized by causing a computer system to read and execute the program recorded in the recording medium in which the above-described program is recorded.

In addition, the "computer system" referred here includes hardware, such as an operating system or peripheral devices.

In addition, "computer-readable recording medium" refers to a portable medium, a storage device, or the like. The portable medium is a flexible disk, a magneto-optical disk, a ROM, a CD-ROM, or the like. Further, the storage device is a hard disk or the like built in the computer system. Furthermore, the "computer-readable recording medium" dynamically holds a program for a short period of time, such as a communication line when transmitting the program via a communication line. The communication line is a network such as the Internet, a telephone line, or the like. In addition, "computer-readable recording medium" may be a volatile memory inside a computer system that serves as a server or a client. The volatile memory holds a program for a certain period of time. Further, the above-described program may be for realizing a part of the above-described functions. In addition, the above-described program may be realized by combining the above-described functions with a program which is already recorded in the computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a roller configured to carry a sheet;

a plurality of developing units each comprising different types of developing materials;

an image forming unit configured to form a plurality of images on a transfer belt with developing materials of each of the plurality of developing units;

a sensor configured to read the plurality of images formed on the transfer belt; and a control unit configured to control a speed of the roller based on positions of the plurality of images on the transfer belt read by the sensor, wherein the control unit controls a rotational speed of the roller when a difference between positions of the plurality of images is equal to or greater than a threshold value.

2. The apparatus according to claim 1, wherein the roller is a resistance roller disposed upstream of a secondary transfer roller, and the control unit increases the rotational speed of the roller by a predetermined amount.

3. The apparatus according to claim 1, wherein the roller is a fixing roller disposed downstream of a secondary transfer roller, and the control unit reduces the rotational speed of the roller by a predetermined amount.

4. The apparatus according to claim 1, wherein the roller is a first roller disposed either upstream or downstream of a secondary transfer roller and a second roller disposed either upstream or downstream where the first roller is not disposed, and the control unit first controls the rotational speed of the first roller or the second roller when the difference between the positions of the plurality of images is equal to or greater than a threshold value, and second controls the rotational speed of the first roller or the second roller which was not controlled at a previous time when the difference between the positions of the plurality of images is equal to or greater than the threshold value after the first control.

5. The apparatus according to claim 1, wherein the roller is a first roller disposed either upstream or downstream of a secondary transfer roller and a second roller disposed either upstream or downstream where the first roller is not disposed, and the control unit controls the rotational speed of the first roller or the second roller when the difference between the positions of each of the plurality of images is equal to or greater than a threshold value, and controls the rotational speed of the first roller or the second roller when the difference between the positions of the plurality of images is less than the threshold value when a paper sheet is not passing.

6. The apparatus according to claim 5, wherein the control unit controls the rotational speed of the first roller or the second roller when the difference between the positions of each of the plurality of images is equal to or greater than a threshold value, and performs alignment correction of an optical system in the plurality of developing units when the difference between the positions of each of the plurality of images is equal to or greater than a threshold value when the paper sheet is not passing.

7. The apparatus according to claim 1, wherein the image forming unit forms the plurality of images at the same place on the transfer belt with the developing material of each of the plurality of developing units.

8. The apparatus according to claim 1, wherein the image forming unit forms the plurality of images on the transfer belt when the sheet is passing.

9. An image forming apparatus comprising:

at least two rollers configured to carry a sheet;

a plurality of developing units each comprising different types of developing materials;

an image forming unit configured to form a plurality of images on a transfer belt with developing materials of each of the plurality of developing units;

a sensor configured to read the plurality of images formed on the transfer belt; and a control unit configured to control a speed of at least one roller based on positions of the plurality of images on the transfer belt read by the sensor, wherein the control unit controls a rotational speed of the roller when a difference between positions of the plurality of images is equal to or greater than a threshold value.

10. The apparatus according to claim 1, wherein the control unit increases or decreases a rotational speed of at least one roller by a predetermined amount.

11. A carrying control method comprising:

carrying a sheet at a speed;

forming a plurality of images on a transfer belt with developing materials of each of different types of developing materials;

reading the plurality of images formed on the transfer belt;

controlling the speed of carrying the sheet based on the read positions of the plurality of images; and controlling a rotational speed of a roller when a difference between positions of the plurality of images is equal to or greater than a threshold value.

12. The carrying control method according to claim 11, wherein the roller is a resistance roller disposed upstream of a secondary transfer roller, and further comprising:

increasing the rotational speed of the roller by a predetermined amount.

13. The carrying control method according to claim 11, wherein the roller is a fixing roller disposed downstream of a secondary transfer roller, and further comprising:

reducing the rotational speed of the roller by a predetermined amount.

14. The carrying control method according to claim 11, wherein the roller is a first roller disposed either upstream or downstream of a secondary transfer roller and a second roller disposed either upstream or downstream where the first roller is not disposed, and further comprising:

first controlling the rotational speed of the first roller or the second roller when the difference between the positions of the plurality of images is equal to or greater than a threshold value; and second controlling the rotational speed of the first roller or the second roller which was not controlled at a previous time when the difference between the positions of the plurality of images is equal to or greater than the threshold value after the first controlling.

15. The carrying control method according to claim 11, wherein the roller is a first roller disposed either upstream or downstream of a secondary transfer roller and a second roller disposed either upstream or downstream where the first roller is not disposed, and further comprising:

controlling the rotational speed of the first roller or the second roller when the difference between the positions of each of the plurality of images is equal to or greater than a threshold value; and controlling the rotational speed of the first roller or the second roller when the difference between the positions of the plurality of images is less than the threshold value when a paper sheet is not passing.

16. The carrying control method according to claim 15, further comprising:

controlling the rotational speed of the first roller or the second roller when the difference between the positions of each of the plurality of images is equal to or greater than a threshold value; and correcting alignment of an optical system in the plurality of developing units when the difference between the positions of each of the plurality of images is equal to or greater than a threshold value when the paper sheet is not passing.

17. The carrying control method according to claim 11, further comprising:

forming the plurality of images at the same place on the transfer belt with the developing material of each of the plurality of developing materials.

18. The carrying control method according to claim 11, further comprising:

forming the plurality of images on the transfer belt when the sheet is passing.

* * * * *